US005547543A

United States Patent [19]

Nykanen et al.

[11] Patent Number: 5,547,543

[45] Date of Patent: Aug. 20, 1996

[54] APPARATUS FOR MINIMIZING EFFLUENT DISCHARGES AND RECOVERING CHEMICALS IN A PULP MILL

[75] Inventors: Tuomo S. Nykanen; Brian F. Greenwood, both of Glens Falls, N.Y.; Johan Gullichsen, Helsinki, Finland; Erkki Kiiskila, Karhula, Finland; Esko Mattelmaki, Varkaus, Finland; Joseph R. Phillips, Glens Falls, N.Y.; Jan Richardsen; Rolf Ryham, both of Roswell, Ga.; Jarmo Soderman, Helsinki; Karl Wiklund, Karhula, both of Finland

[73] Assignee: Ahlstrom Machinery Inc., Glen Falls, N.Y.

[21] Appl. No.: 274,091

[22] Filed: Jul. 12, 1994

Related U.S. Application Data

[62] Division of Ser. No. 922,334, Jul. 30, 1992, Pat. No. 5,374,333.

[51] Int. Cl.[6] ..... D21C 11/12

[52] U.S. Cl. ..... 162/31; 162/30.1; 162/239; 162/240; 162/DIG.8

[58] Field of Search ..... 162/19, 29, 30.1, 162/30.11, 31, DIG 8, 239, 240

[56] References Cited

U.S. PATENT DOCUMENTS

| | | | |
|---|---|---|---|
| 4,135,968 | 1/1979 | Dehaas | 162/30 R |
| 5,127,992 | 7/1992 | Davies et al. | 162/29 |
| 5,145,557 | 9/1992 | Peter et al. | 162/78 |
| 5,174,859 | 12/1992 | Rittof et al. | 162/29 |
| 5,284,550 | 2/1994 | Tanca et al. | 162/31 |
| 5,328,564 | 7/1994 | Tiang et al. | 162/38 |
| 5,382,322 | 1/1995 | Magnotta et al. | 162/30.11 |

FOREIGN PATENT DOCUMENTS

| | | |
|---|---|---|
| 989558 | 5/1976 | Canada . |
| 2041536 | 11/1991 | Canada . |

OTHER PUBLICATIONS

"Great Lakes Paper . . . Pulp Mill", Paper Trade Journal, Mar. 15, 1977, pp. 29–34.

Kelsey, Harley, "The Closed Loop", Ecotech, BC Discovery Nov./Dec. 1990, pp. 8–10, 28–29.

Rapson, H. "The Effluent Free Bleached Kraft Pulp Mill", Tappi, vol. 56, No. 9, Sep. 1973, pp. 112–114.

Myreen, Bertel, "Closing Up the bleach Plant", Okko Poyry, Jun. 1991.

Macas T., "Achieving high Pulp brightness . . . chlorine compds", Internation Pulp Bleach Conf, Jun. 1991—vol. 3. Production of Bleached Chemical Pulp in the Future.

*Primary Examiner*—Donald E. Czaja
*Assistant Examiner*—Dean T. Nguyen
*Attorney, Agent, or Firm*—Nixon & Vanderhye P.C.

[57] ABSTRACT

Apparatus for a pulp and paper mill, and methods of acting on liquid effluents produced in the mill, which minimizes the discharge of polluting gaseous and liquid effluents to the environment. Liquid effluents from the bleach plant are concentrated (e.g. evaporated), incinerated (e.g. gasified), leached, crystallized (e.g. freeze crystallized) then washed, and then fed to the plant chemical recovery loop. White liquor produced from the recovery boiler melt is fully oxidized and used in place of caustic in the bleach plant. Essentially all sulfuric acid, sulfur dioxide, caustic, and chlorine dioxide necessary for the pulp mill is produced from mill liquid effluents and gas waste streams, on site at the pulp mill. Typical bleaching sequences that can be used are $DE_{op}D_nD$, or $AZE_o$ PZP.

14 Claims, 5 Drawing Sheets

TO FIG 2B

14
EVAP
RECOVERY BOILER
19
24
SD TANK
22
GREEN LIQUOR CLARIFIER
57
SLAKER CAUST
58
WHITE LIQ ECO FILTER
23
MUD FILTER
59
PC FILTER
60
WL OX
25
WL OX
$N_2$
$CO_2$
$H_2O$
$SO_2$
$SO_2$
$H_2SO_4$
PRCIP
COOL TOWER
COND TURB
MP STEAM
LP STEAM
NCG
KILN
61
$N_2$
$SO_2$
$H_2O$
$CO_2$
$SO_2$
$H_2SO_4$
PRCIP

TO FIG 2A.

WDYRD
45
HOG BOILER
46
FLY ASH
DIGESTER
10
BS WASH
47
SCREEN ROOM
48
PRESS
49
O2 DELIGN
11
PO WASH
50
12
51
D100
Eop
Dn
D2
52
53
54
29
1
2
27
28
30
EVAPORATORS
3
41
CONCEN-TRATOR
31
32
INCINERATOR
Na2SO4
NaCl
Na2CO3
METALS
LEACH
33
SPILL STORAGE
40'
CLARIF
40
38
39
SPILL CONT.
ClO2 PRODUCTION
37
13
WET END
55
SEALWATR
WTR TRT PLANT
42
65
66
FEED WATER
DRYER
56
STORAGE
57'
CRYSTAL WASH
Na2CO3
Na2SO4
34
35
DREG
63
64
LAND FILL

TO FIG 3B

CHIPS IN
110
147
148
111
150
$O_2$
70
71
A
68
69
COOLING WATER IN
COOLING WATER OUT
129
127
TO
142
WATER TREATMENT PLANT
TANK
CLEAN COND.
131
FOUL COND.
DFF GAS
STRIPPED COND.
FRESH STM
FEED
HPS
HPS COND.
LIVE STIM. COND.
133
134
INCINER-ATE
LEACH
CRYSTALIZE, WASH
PROD LIQ
132
135
RECOVERY LOOP
119 etc.

APPARATUS FOR MINIMIZING EFFLUENT DISCHARGES AND RECOVERING CHEMICALS IN A PULP MILL

This application is a division of application Ser. No. 07/922,334 filed Jul. 30, 1992 now U.S. Pat. No. 5,374,333.

BACKGROUND AND SUMMARY OF THE INVENTION

It has long been a desire of those working in the paper pulp art to produce a pulp mill that does not in any way significantly pollute the environment. A number of proposals have been made for such a pulp mill in the past, but the desired goal has yet to be achieved. For example, a "closed mill" was constructed at Great Lakes Forest Products, Thunder Bay, Ontario, in the 1970s, but it was difficult to run the mill closed for extended periods of time as a result of corrosion problems in the recovery boiler, and elsewhere, due to chloride buildup. See "Bleaching in the Closed Cycle Mill at Great Lakes Forest Products Ltd." by Pattyson et al, Pulp & Paper Canada, Vol. 82, No. 6, pp. 113–122 (1981). In the Great Lakes mill, bleaching plant effluents were introduced directly into the chemical recovery loop, as shown schematically in U.S. Pat. No. 4,039,372.

More recently, it has been proposed by HPD and Jaakko Poyry that closing of a pulp mill can be accomplished by evaporating acid effluent and then returning the $E_O$ bleach plant effluent to the brown stock washers. However that approach has yet to be successful, despite the utilization of inexpensive plastic laminate, falling film evaporators which allow effective evaporation of the bleaching chemicals, and it is believed unlikely that it will ultimately be successful because of the buildup of undesired chemicals due to the introduction of the flow from the $E_o$stage back to the brown stock washing stage.

According to the present invention, a method and apparatus are provided which utilize only existing technology, so that future development of sophisticated additional equipment or processes is not necessary, which essentially can reduce the liquid polluting effluents from a pulp mill to zero, provide only a minimum amount of solid waste for disposal (and provide the high probability that such solid waste can be used in an environmentally acceptable manner), and minimize the production of gaseous $NO_x$ and $SO_x$ products, so that the only significant gaseous pollutant from the pulp mill is carbon dioxide.

One of the basic aspects of the present invention that makes it possible to achieve these beneficial results is to treat the bleaching effluents completely separately from the chemical recovery loop until the effluents are in a particularly desirable form, and to then introduce the chemicals in that desirable form into the recovery loop. Another significant aspect of the present invention is the essentially complete oxidation of white liquor produced in the chemical recovery loop, which is then returned to the bleaching stage so that the proper balance between the various chemical treatment sequences is provided. Another significant aspect of the present invention that allows the desired results to be achieved are the production on site at the pulp mill, directly from the effluent streams and gaseous waste streams themselves, of essentially all of the sulfur dioxide, sulfuric acid, caustic or caustic substitute, and (if utilized) chlorine dioxide necessary to effect treatment of the pulp and recovery of the chemicals. Another factor which minimizes the amount of bleach plant effluents so as to make a proper treatment thereof practical, is advanced digesting techniques where delignification can be extended so that the pulp—without significant strength loss—discharged from the digesting stages has a low Kappa No. (e.g. 24 or below) and then the pulp is subjected to oxygen delignification to reduce the Kappa No. still further (e.g. to 14 or below, typically 10 or below) before bleaching is effected, allowing the production of prime market pulp (e.g. 88–90 ISO).

The ability to produce prime market pulp with minimal adverse affect on the environment, according to the invention, is a quantum leap forward in pulping technology, and allows fulfillment of a long felt need to accomplish this desirable result.

According to one aspect of the present invention, a method of minimizing effluents from a cellulose pulp mill having a digester, bleach plant, and a recovery boiler and chemical recovery loop, is provided. The method comprises the following steps: (a) Concentrating (e.g. by evaporation) liquid effluents from the bleach plant to a concentration level high enough for incineration. (b) Incinerating the concentrated bleach plant effluents to produce a residue containing sodium, sulfate, carbonate, and sodium chloride. (c) Leaching the residue to produce a leachate. And, (d) feeding at least a substantial portion of the leachate to the chemical recovery loop associated with the recovery boiler.

The method also preferably comprises the further steps of: (e) Removing black liquor from the digester. (f) Increasing the solids concentration of the black liquor to a level high enough for incineration. (g) Incinerating the concentrated black liquor in the recovery boiler to produce a melt. (h) Producing white liquor and/or NaOH from materials in the recovery loop including the melt and the leachate fed to the recovery loop. (i) Oxidizing at least a part of the white liquor. And, (j) using at least a part of the oxidized white liquor in place of caustic in the bleach plant.

The invention also contemplates collecting spills of liquid from the pulp mill, evaporating the collected spills, and adding the concentrated spills to the concentrated bleach plant effluents in order to practice step (b). The spills are typically clarified before evaporation. There also are preferably the further steps of treating water removed from the bleach plant effluents by concentrating them, and then using the treated water as wash water in the bleach plant and in other mill processes.

Also there preferably are the further steps of producing substantially all caustic (or caustic substitute such as essentially completely oxidized white liquor) for the bleach plant, sulfuric acid, and sulfur dioxide needed for the plant processes, from process effluents and gaseous streams on site at the pulp mill so that no substantial external source of supply thereof need be provided.

Prior to feeding the leachate to the recovery loop, it is preferred that the leachate be crystallized and washed. The leachate also typically includes sodium chloride, and leachate containing chloride is used in the plant to produce substantially all of the chlorine dioxide necessary for the bleach plant. All of the metals above monovalent are removed from the leachate by washing, and those metals are kept out of the recovery loop and away from the bleach plant.

The bleach plant may have both acid and alkali liquid effluents, in which case it is desirable to initially evaporate (or otherwise concentrate) those different effluents separately, and then combine them for a final evaporation (concentration) before incineration. One typical bleaching sequence for the bleach plant may be $DE_oPD_nD$ (where $_n$ refers to a neutralization stage between the two chlorine dioxide stages), and another typical bleaching sequence is $AZE_oPZP$, although a wide variety of other bleaching sequences may also be utilized.

The invention also contemplates a method of recovering chemicals from bleach plant liquid effluents resulting from the production of chemical cellulose pulp by the following steps: (a) Concentrating (e.g. evaporating) the bleach plant liquid effluents to produce a concentrated effluent. (b) Incinerating the concentrated effluent to produce a residue. (c) Acting on the residue to recover sodium, sulfate, carbonate and/or sodium chloride. And, (d) using the recovered sodium, NaCl, sulfate and/or carbonate in the production of the chemical cellulose pulp.

The invention also contemplates a method of producing cellulose chemical pulp in a pulp mill, which requires sulfur dioxide, sulfuric acid, and caustic, and which has process effluents and gaseous streams, comprising the step of producing all of the sulfuric acid, sulfur dioxide, and caustic (or caustic substitute) necessary to effectively produce chemical pulp directly at the pulp mill, from the process effluents and gas streams, so that substantially no additional sulfuric acid, sulfur dioxide, or caustic is necessary from external sources.

According to another aspect of the present invention, apparatus for producing chemical pulp with a minimum discharge of effluents is provided. The apparatus comprises: A digester. A chemical recovery loop operatively connected to the digester, and including a recovery boiler. A bleach plant including at least one liquid effluent line therefrom. Concentrating means (e.g. evaporators) connected to the liquid effluent line from the bleach plant to produce a concentrated effluent. An incinerator for incinerating the concentrated effluent from the evaporator means, for producing a residue. And, means for recovering sodium, NaCl, carbonate and/or sulfate from the incinerator residue and feeding at least some of those recovered materials to the recovery loop. Also, water is recovered from the bleach plant effluents, which is used elsewhere in the mill.

The evaporator means preferably comprise a plurality of stages of metal-plastic laminate, falling film evaporators. Such evaporators are available from A. Ahlstrom Corporation of Helsinki, Finland, and Ahlstrom Recovery Inc. of Roswell, Ga. under the trademark "Zedivap", and described in co-pending application Ser. No. 07/974,060 filed Nov. 12, 1992, now abandoned in favor of continuation-in-part application Ser. No. 08/222,273 filed Apr. 04, 1994(corresponding to Finnish Application 915424 filed Nov. 18, 1991, and the disclosure of which is incorporated by reference herein). Although other evaporators, such as desalination evaporators, also are feasible, the "Zedivap"™ evaporators are particularly advantageous and make the evaporating process for the bleach plant effluents practical. The evaporator means also may further comprise a concentrator between the stages of metal-plastic laminate evaporators and the incinerator.

According to yet another aspect of the present invention, the following apparatus is provided: A bleach plant for bleaching cellulose chemical pulp, and producing liquid effluents during bleaching. Means for concentrating (e.g. evaporating) the bleach plant liquid effluents to produce a concentrated effluent. An incinerator for incinerating the concentrated effluent to produce a residue. Means for acting on the residue to recover sodium, sulfate, NaCl, and/or carbonate. And, means for using the recovered sodium, sulfate, NaCl, and/or carbonate in the production of the chemical cellulose pulp being bleached.

The invention also contemplates the following apparatus: Means for acting upon all liquid effluents in the pulp mill so that no liquid effluents are discharged from the pulp mill to the environment. And, means for acting on all gaseous effluents from the pulp mill so that the amount of $SO_x$ and $No_x$ are minimized, and the only major adverse gaseous effluent is carbon dioxide.

According to still another aspect of the present invention there is provided the method of: Digesting comminuted cellulosic fibrous material to a Kappa No. of about 24 or below. Effecting oxygen delignification of the digested pulp to a Kappa No. of about 14 or below. Bleaching the oxygen delignified pulp to produce bleach liquid effluents. Concentrating (e.g. evaporating) the liquid bleach effluents into a concentrated effluent. Incinerating the concentrated effluent to produce a residue. And, acting on the residue to recover chemicals therefrom used in the digesting, oxygen delignification, and/or bleaching stages, while also recovering water.

It is the primary object of the present invention to provide for the production of cellulose chemical pulp with essentially zero discharge of liquid pollutants to the environment, with a minimum amount of gaseous pollution, and with the minimum amount of solid waste products. This and other objects of the invention will become clear from an inspection of the detailed description of the invention, and from the appended claims.

BRIEF DESCRIPTION OF THE DRAWINGS

FIGS. 3A–3B schematic of an alternative system according to the present invention based upon the same concepts as the systems of FIGS. 1 and 2A–2B only showing different details of the handling of bleach plant effluents, the particular bleach plant stages involved, and the like.

DETAILED DESCRIPTION OF THE DRAWINGS

Figure 1:
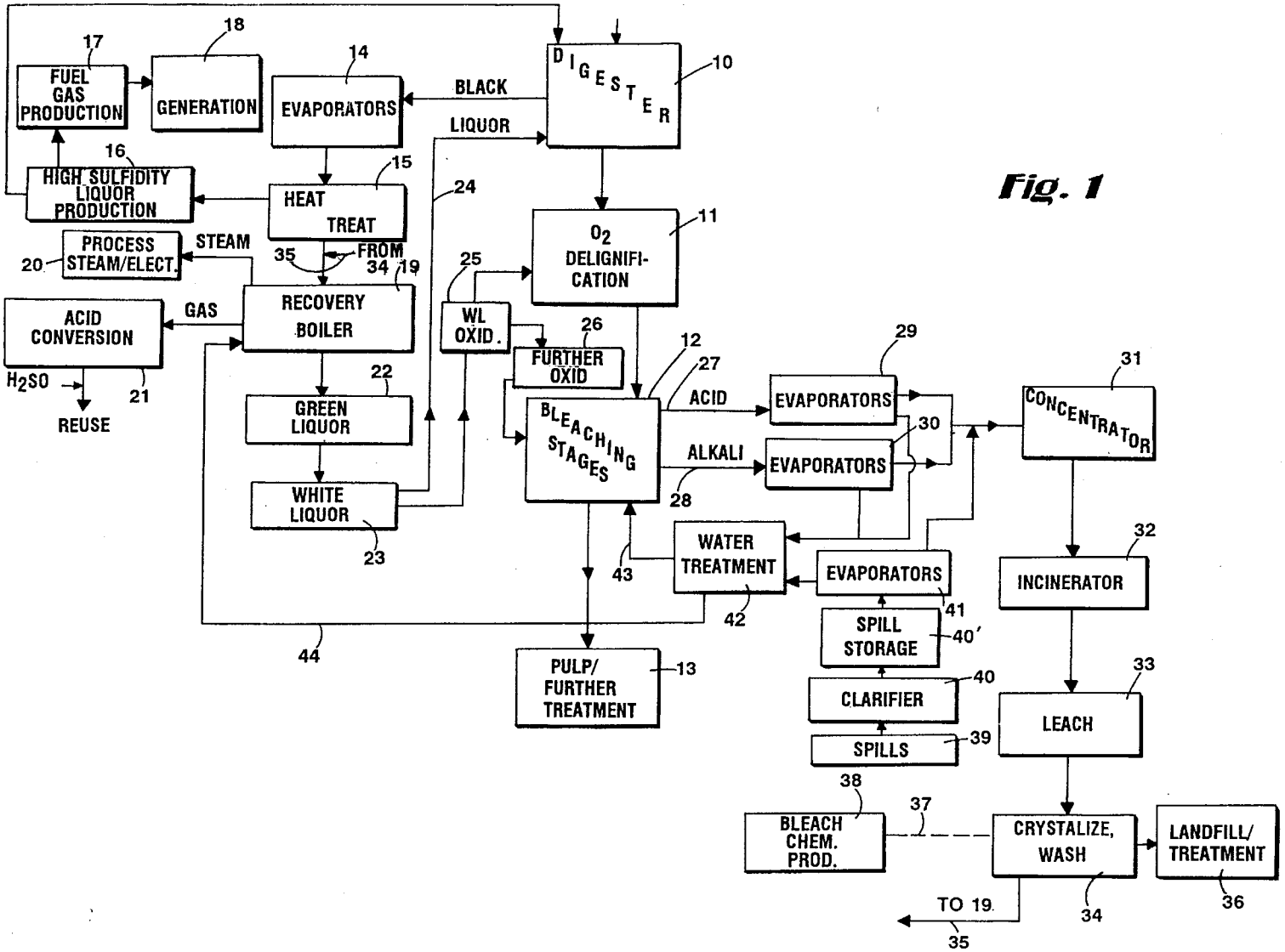
FIG. 1 is a schematic view of the most basic components of one exemplary system according to the present invention, and for practicing exemplary methods according to the present invention.

The exemplary system illustrated in FIG. 1 includes a conventional digester 10, such as a Kamyr® continuous digester, to which hard wood or soft wood chips, or other comminuted cellulosic material, is fed. In the digester 10 the wood chips are acted upon by the cooking chemicals at conventional temperature and pressure conditions so as to produce chemical cellulose pulp, such as kraft pulp, which then is preferably subjected to oxygen delignification at stage 11. According to the present invention it is desirable to delignify the pulp so that it has a minimum Kappa No. when discharged from the digester 10, such as by using a Kamyr EMCC® digester and process, which produces a Kappa No. of about 24 or below. The oxygen delignification stage 11 reduces the Kappa No. to about 14 or below, preferably to about 10 or below.

After oxygen delignification, the pulp proceeds to the bleach plant 12 where it is subjected to bleaching in a plurality of different bleaching stages. The particular bleaching stages that are utilized can be varied, and are also dependent upon the particular cellulose material being treated. After the bleaching stages 12, the pulp may proceed on to storage or further treatment stages 13. For example the pulp may be dried and then shipped to a paper mill.

As is conventional, black liquor is withdrawn from the digester 10 (or brown stock washer associated therewith), and is passed to evaporators 14. The black liquor also is preferably subjected to heat treatment such as shown in U.S. Pat. No. 4,929,307 (the disclosure of which is hereby incorporated by reference herein). Sulfur containing gases driven off by the heat treatment 15 may be handled as shown in co-pending application Ser. No. 07/788,151 filed Nov. 5, 1991 now abandoned, for example to produce high sulfidity liquor at stage 16, where the production of fuel gas (e.g. primarily methane) as indicated schematically at 17, makes possible generation of power as indicated generally at 18.

After treatment at stage 15 the black liquor is ultimately passed (there may be intervening evaporation stages if desired) to a conventional recovery boiler 19. Steam produced from the recovery boiler 19, as indicated generally at 20 in FIG. 1, is used for various processes within the pulp mill. The gases discharged from the recovery boiler 19 include sulfur dioxide which can be used as the feed material for the production of sulfuric acid according to conventional techniques. As indicated at 21 in FIG. 1, sulfur dioxide and sulfuric acid (produced from the $SO_2$) can be used wherever necessary in the mill. For example the sulfur dioxide is used as an anti-chlor for the last stage of chlorine dioxide bleaching (if utilized), and for the tall oil plant. According to the invention, sufficient sulfur dioxide and sulfuric acid are available from block 21 to fulfill the needs of the pulp mill without requiring those chemicals from an external source. While of course one cannot expect the chemical recoveries and consumptions to balance exactly, according to the invention they may be expected to be within a few percent of each other. Of course any small amount of excess chemical can be sold, and any deficiency made up by purchase.

The melt from the recovery boiler 19, as is conventional, is used to form green liquor as indicated by reference numeral 22 in FIG. 1, and the green liquor is then preferably ultimately used to make white liquor, as indicated generally by reference numeral 23 in FIG. 1. Alternatively, or in addition, the green liquor may be crystallized and otherwise acted upon to produce essentially sulfur free sodium hydroxide, as disclosed in co-pending application Ser. No. 07/918,855 filed Jul. 27, 1992 now abandoned, the disclosure of which is incorporated by reference herein.

The sulfur content of the melt may be adjusted by bringing a portion of the melt discharged from the recovery boiler 19 into contact with a sulphurous gas of the pulp mill. Also, one can thermally split the methyl mercaptan and dimethyl sulphide of the sulphurous gas into ethene and hydrogen sulphide before it is brought into contact with the melt, or into contact with ash from the recovery boiler 19. Any white liquor produced from this melt will have controlled and/or enhanced sulfidity. These techniques are disclosed in Finnish Applications 914585 and 914586, both filed Sep. 27, 1991.

Some of the white liquor is fed via line 24 back to the digester 10, and according to the present invention, in order to balance the chemical flows, it is highly desirable that a portion of the white liquor from 23 be oxidized at stage 25 in a conventional or known manner, and then used in the oxygen delignification stage 11. One known manner of oxidation termed "bubbleless membrane aeration" is described in an article by Michael Semmens in the April, 1991 edition of "WATER/Engineering & Management", pp 18 & 19. Also, a portion of the oxidized white liquor from 25 is preferably subjected to a second oxidation stage 26—such as shown in co-pending application Ser. No. 07/910,874, filed Jul. 9, 1992 now abandoned (the disclosure of which is hereby incorporated by reference herein)—in order to oxidize all of the sulfur forms within the white liquor to sulfates. The resulting essentially completely oxidized white liquor is then returned to the bleaching plant 12 and used in place of caustic in the bleach plant 12. Sufficient oxidized white liquor can be produced in 26 according to the invention so that all of the caustic needs for the bleach plant 12 are taken care of, without the necessity of requiring caustic from an external source.

Also according to the present invention, the liquid effluents from the bleach plant 12—such as the acid effluent in line 27 from the first bleaching stage, and the alkali effluent in line 28 from the second bleaching stage—are concentrated, e.g. by passage to evaporator stages 29, 30, respectively. The evaporators which comprise the stages 29, 30 preferably are low cost metal-plastic laminate, falling film evaporators, such as sold by A. Ahlstrom Corporation of Helsinki, Finland and Ahlstrom Recovery Inc. under the trademark "Zedivap". Such laminates are typically of aluminum (or brass or copper) and plastic (e.g. polyethylene, polypropylene, or polyester), each layer having a thickness of less than 100 μm. For example an aluminum layer may be 9–18 μm thick, and a polyester layer 12–25 μm thick. A plastic film may be extruded on a metal foil to produce a laminate. A heat exchanger is formed by attaching two rectangular laminated strips to each other, for example by a glued joint. The laminated strips may also be connected to each other by dot-like junction points between the joints at the edges. The pulp mill liquids may flow down the plastic layer, or the metal layer. Such an evaporator surface is disclosed in co-pending application Ser. No. 07/974,060 filed Nov. 12, 1992, now abandoned in favor of continuation-in-part application Ser. No. 08/113,642 filed Aug. 12, 1993 (corresponding to Finnish Application 915424 filed Nov. 18, 1991, and the disclosure of which is incorporated by reference herein). However, conventional desalination evaporators may be used instead.

Where both acid and alkali liquid effluent lines 27, 28 are provided, it is desirable not to mix them until the effluents have been concentrated in the evaporators 29, 30 otherwise a severe foaming problem may ensue. If the foaming problem can be overcome, then the lines 27, 28 may be combined before the evaporators 29, 30.

After the stages 29, 30, the more concentrated effluent passes to the concentrator 31, which comprises a series of high-efficiency evaporator stages which concentrate the effluent to a sufficient level so that it can be incinerated. For example, the concentration of the effluent in lines 27 and 28 may be 0.2–0.5% solids, which is concentrated to a solids content of about 10–30% by the evaporators 29, 30, and then concentrated to a concentration of about 50–60% by the concentrator 31.

Concentration of the bleach plant effluents may be accomplished by other techniques aside from evaporation. For example, conventional ultra-filtration, reverse osmosis, freeze crystallization, or a combination of these techniques with each other and/or with evaporation, may be utilized to produce effluent with a sufficiently high concentration.

The concentrated effluent from the concentrator 31 or the like is fed to an incinerator 32 where it is burned to produce a residue. Incineration may be practiced according to a number of conventional or known techniques, such as slagging combustion or gasification (as by means of a circulating fluidized bed gasifier).

Valuable chemical components of the residue from incinerator 32 are ultimately returned to the recovery loop (i.e. components 14, 15, 19, 22, 23, etc.). In order to effectively return valuable components of the residue, such as sodium, sulfate, and carbonate, the residue is preferably leached by a conventional leaching apparatus, as indicated at 33 in FIG. 1. Preferably, the leachate from the leaching stage 33 is crystallized (e.g. freeze crystallized; see U.S. Pat. Nos. 4,420,318, 4,505,728, and 4,654,064) and washed as indicated at 34. Leaching and crystallizing per se (although in a recovery loop) are known as indicated by TAPPI Journal Volume 66, No. 7, July, 1983 "Recovering Chemicals in a Closed Sulfite Mill" by Davies et al.

The crystallized and washed leachate from stage 34 (or at least a portion thereof) is fed—via line 35—to the recovery loop, such as just before the recovery boiler 19. In that way the valuable chemicals from the bleach plant effluent in lines 27, 28 are returned to the recovery loop. The washing separates out metals above monovalent, such as calcium and magnesium, which may be land-filled or treated—as indicated at 36 in FIG. 1. The solid material at 36 is essentially the only solid waste material from the pulp mill of FIG. 1, and only comprises about 5% of the chemicals from the residue of incinerator 32, the other 95% being used elsewhere (e.g. in the recovery loop).

The residue from the incinerator 32 also typically includes sodium chloride, and the chlorine content thereof can be used—as indicated by dotted line 37 and box 38 in FIG. 1—to produce chlorine dioxide and sodium chloride. In this circumstance, some of the leachate from stage 34 flows to the chlorine dioxide production stage 38, while the rest is returned to the recovery loop via line 35.

In many pulp mills, regardless of age, the amount of spill liquid can be a significant percentage of the total liquid effluents. Spill liquids as high as 33% of a mill total liquid effluents (including the bleach plant liquid effluents in lines 27, 28) are not unusual. Of course if such spills are allowed to leak into the environment, then the goal of a low or zero discharge mill will not be realized. Therefore according to the present invention, the liquid spills—preferably from the entire pulp mill—are collected utilizing conventional drainage and collection systems, as indicated schematically at 39 in FIG. 1. Those spills are then clarified in the clarifier 40, and passed to spill storage 40' and then to the evaporator stages 41. The evaporators in stages 41 are preferably Zedivap® evaporators. The concentrated spills from the evaporators 41 are then combined with the concentrated effluents from evaporators 29 and 30, and passed to concentrator 31.

Of course all of the evaporator stages 29, 30, and 41 will produce water, which has been removed from the bleach plants effluents during the concentrating action thereof. The water from each of the evaporator stages 29, 30, and 41 is passed to a water treatment facility 42 which treats it so that it does not have any components which are harmful if the water is used for other purposes. This "recovery" of water is also a big advantage of the method and apparatus according to the invention. Part of the water is then returned, via line 43, to the bleach plant 12 to serve as wash liquid flowing countercurrently to the pulp from one stage to another in the bleach plant 12, while another part of the water passes in line 44, which goes to the recovery boiler 19 as feed water, for the production of process steam at 20.

Figure 2A:
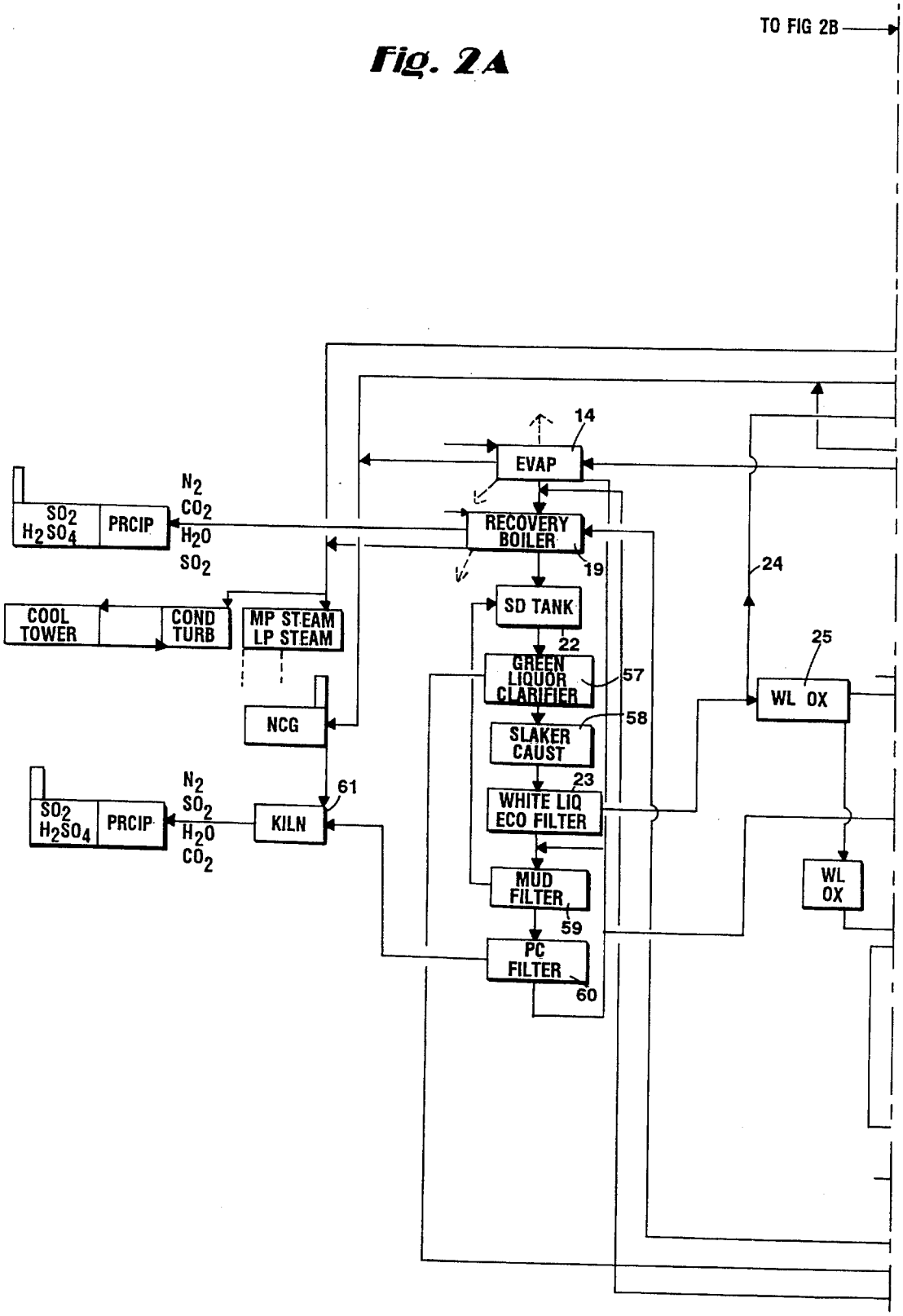
FIGS. 2A–2B flow sheets similar to that of FIG. 1, only showing a number of the particular processes involved in more detail.
Figure 2B:
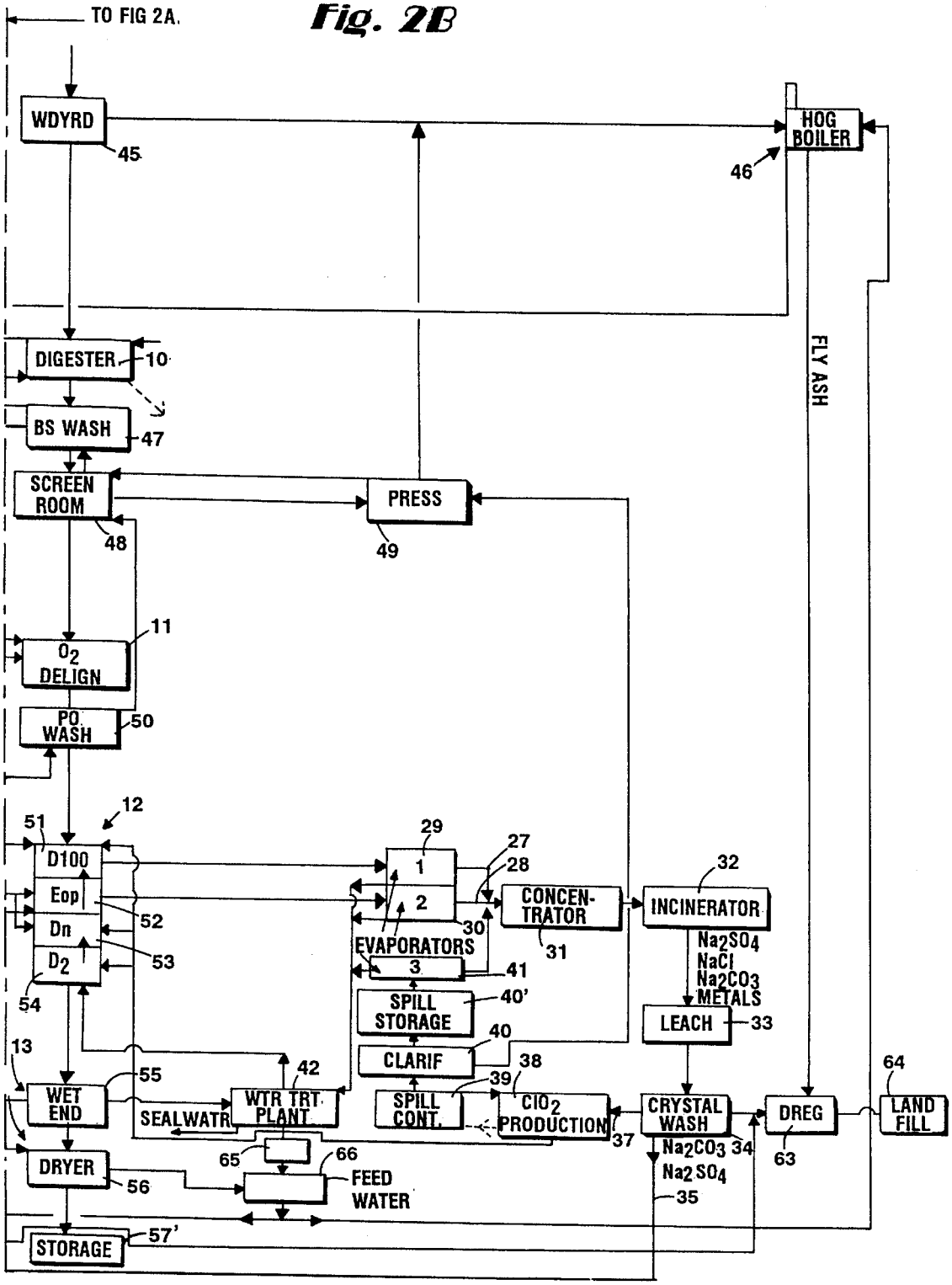

FIGS. 2A–2B provide illustrations of the same basic system, for practicing the same basic method, as in FIG. 1, only shows a number of the components in more detail. In the illustration of FIGS. 2A–B components comparable to those in FIG. 1 are shown by the same reference numeral.

In the illustration in FIG. 2B, a wood yard 45 is shown connected to the digester 10, and also to a conventional hog fuel boiler 46. A brown stock washing stage 47 is disclosed after the digester 10, as well as a screen room 48 cooperating with a press 49, the press 49 also connected to the clarifier 40. Downstream of the oxygen delignification stage 11 is a further washing stage 50, which is then connected to the first stage 51 of the bleach plant 12. In the embodiment illustrated in FIG. 2B, the first bleaching stage 51 is a 100% chlorine dioxide stage. The second stage 52 is an $E_{op}$ stage, a source of caustic being provided by the oxidized white liquor from 26. A third bleach stage 53 is a neutral chlorine dioxide stage. That is a portion of the oxidized white liquor from source 26 (or caustic) is added to the top of the tower of stage 53 in order to neutralize the pulp acidity. The fourth stage 54 is a last chlorine dioxide stage. Chlorine dioxide from the production stage 38 is fed to each of the stages 51, 53, and 54, while a portion of the wash water from the water treatment plant 42 enters the fourth stage 54.

The further treatment stages 13 in the FIG. 2B illustration include the "wet end" 55 and dryer 56, which may be connected to a storage facility 57'.

As part of the recovery system, other conventional components are illustrated in FIG. 2A, such as the green liquor clarifier 57, the slaker 58 for causticizing the green liquor, and the lime mud handling components including the mud filter 59, pre-coat filter 60, lime kiln 61, etc.

Associated with the components acting upon the bleach plant effluents is the dregs stage 63, which may be supplied with the higher than monovalent metals from the crystallizing and wash stage 34, as well as fly ash from the hog fuel boiler 46. The materials from the drag stage 63 may be passed to a land-fill 64, or treated to recover the chemicals therefrom, or the chemicals therein can be utilized in an environmentally acceptable manner.

Also illustrated in FIG. 2B is an optional ozone treatment stage 65 for treating water from the water treatment plant 42. The water from plant 42 is ozonated before flowing to the feed water source 66 which supplies the recovery boiler 19, and which also receives water from the dryer 56. Water from the wet end 55 may pass to the water treatment plant 42, or to the interface between the second and third bleaching stages 52, 53.

Figure 3A:
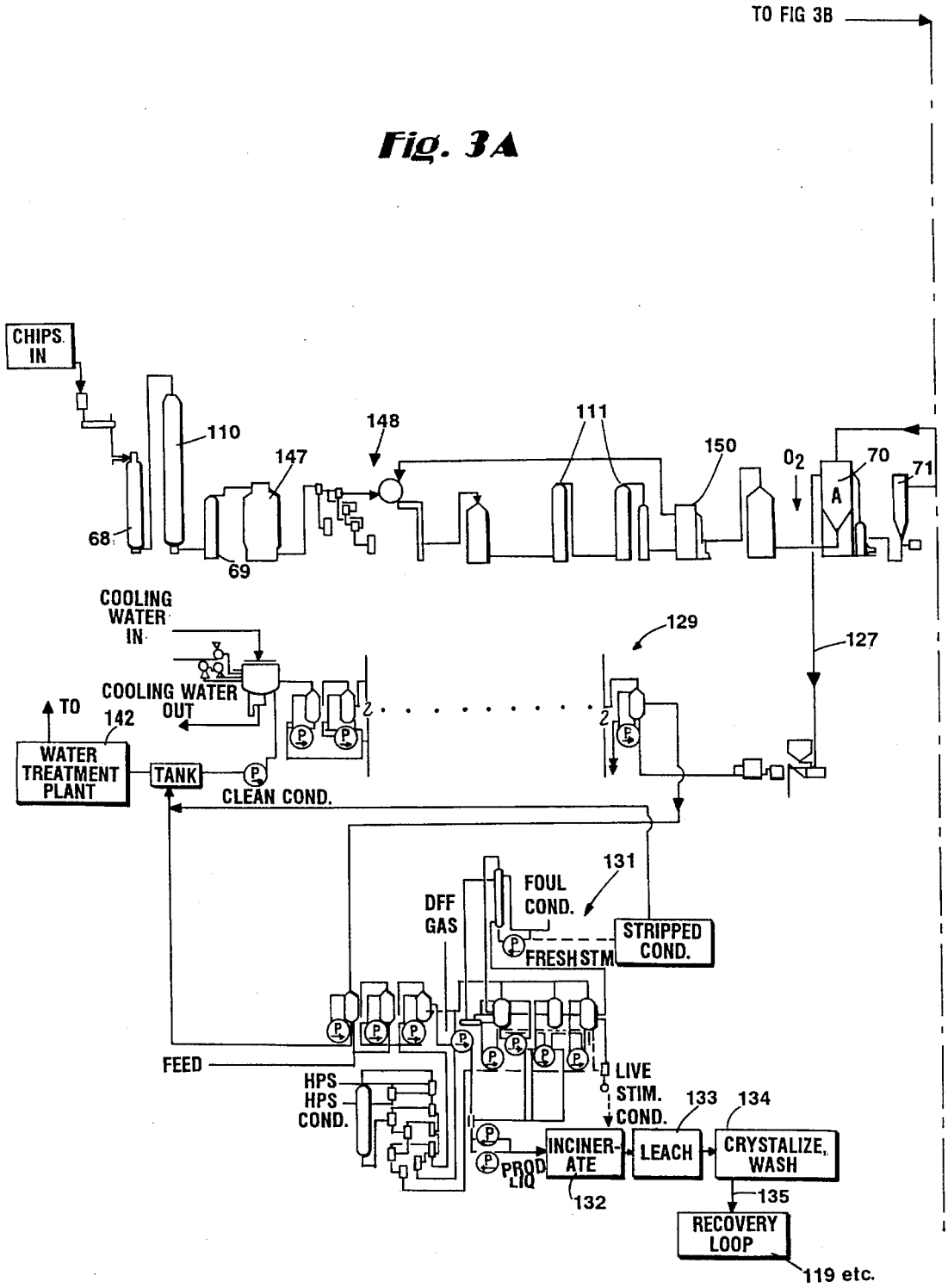
Figure 3B:
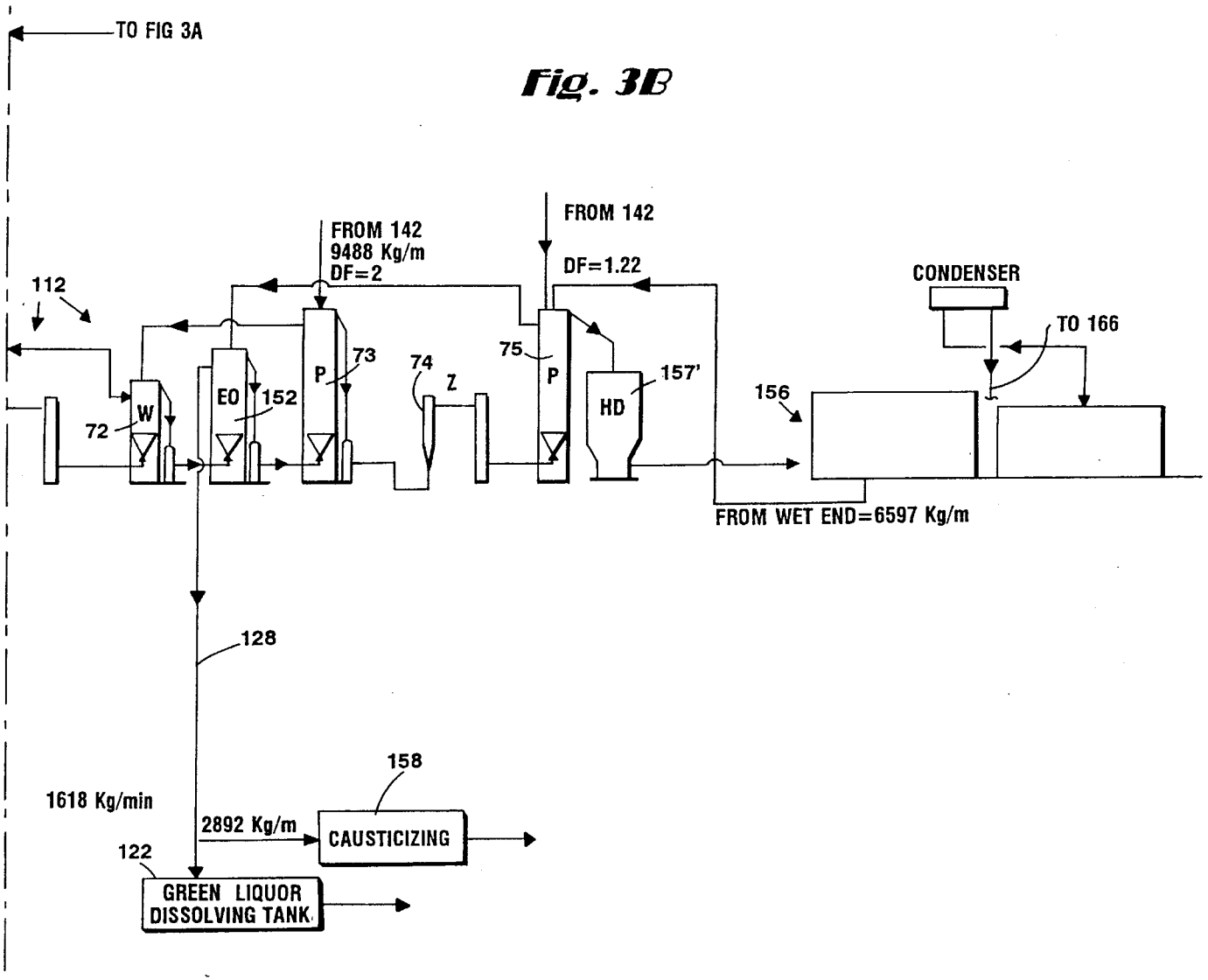

FIGS. 3A–B illustrate another alternative system according to the present invention. One of the major differences between the system of FIGS. 3A–3B and that of FIGS. 1 and 2A–2B is in the particular bleach sequence which is provided, namely an $AZE_o$ PZP bleach sequence. In FIGS. 3A–2B components comparable to those in the FIGS. 1 and 2A–2B embodiments are shown by the same reference numeral only preceded by a "1". Also FIGS. 3A–3B schematically illustrate a number of the components used in the system rather than merely showing them in block diagram, as in FIGS. 1 and 2A–2B.

The digester 110 may be part of a two vessel hydraulic system, including an impregnation vessel 68, such as an EMCC® digester sold by Kamyr, Inc. of Glens Falls, N.Y. A pressure diffuser, 69, or similar brown stock washer may be downstream of the digester 110, which in turn is connected to high-density storage tank, 147, and then the brown stock screen room 148. The oxygen delignification reactors 111 are connected to the post oxygen washing stage 150, which is then connected to the first bleach stage 70, in this case an acid, "A", stage. The second stage of the bleach plant 112 is the first ozone stage 71, and after a wash 72 the $E_o$stage 152 is provided. Following the $E_o$stage 152 is a first peroxide stage 73, then the second ozone stage 74, and the second peroxide stage 75, connected up to the high density storage tank 157'.

In the embodiment of FIGS. 3A–3B, the acid bleach plant effluent line 127 is connected to the Zedivap™ evaporator stages 129, just like in the FIGS. 1 and 2A–2B embodiment, which in turn are connected to the concentrator 131, incinerator 132, leach stage 133, and crystallizing and wash stage 134. However the alkaline effluent line 128 is not connected up to evaporators, but instead is connected up to the recovery loop, typically to the green liquor dissolving tank 122. Also a part of the alkali effluent in line 128 may be used for causticizing, e.g. connected to stage 158; however, much of the alkali effluent would be added to the post-oxygen washing stage.

The pulp mills of FIGS. 1 through 3A–3B, in addition to producing essentially zero liquid effluent discharges, produce little air pollution. Sulfur dioxide and other sulfur compounds are recovered from the recovery boilers 19, 119 stacks, and electrostatic precipitators are also provided in the stacks. Also, the recovery boilers 19, 119 and all the other components, such as incinerators 32, 132, are operated so as to have minimal $NO_x$ discharge. The major gaseous pollutant, then, from the pulp mill will only be carbon dioxide.

It will thus be seen that according to the present invention an effective method and apparatus have been provided for absolutely minimizing effluents from a cellulose pulp mill. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. Apparatus for producing chemical pulp with a minimum discharge of effluents, comprising:

a digester;

a chemical recovery loop operatively connected to said digester, and including a recovery boiler;

a bleach plant including at least one liquid effluent line therefrom;

concentrating means connected to said liquid effluent line from said bleach plant for producing a concentrated effluent;

an incinerator, distinct from said recovery boiler, in flow communication with said concentrating means for incinerating the concentrated effluent from said concentrating means and producing a residue;

recovering means in flow communication with said incinerator for recovering sodium, carbonate and/or sulfate materials from the incinerator residue and feeding means in flow communication from said recovering means to said recovery loop for feeding the recovered materials to the recovery loop.

2. Apparatus as recited in claim 1 wherein said concentrating means comprise a plurality of stages of metal-plastic laminate, falling film evaporators.

3. Apparatus as recited in claim 2 wherein said metal-plastic laminate, falling film evaporators, comprise plates comprising a laminate of aluminum and polyester, polyethylene, or polypropylene plastic, each layer having a thickness substantially less than 100 μm.

4. Apparatus as recited in claim 1 wherein said recovery loop further comprises means for producing white liquor; and further comprising means for oxidizing the white liquor connected to said white liquor production means; and means for feeding the oxidized white liquor to said bleach plant.

5. Apparatus as recited in claim 4 wherein said means for oxidizing said white liquor comprises means for substantially completely oxidizing all the sulfur forms of at least a part of the white liquor to produce sulfates.

6. Apparatus as recited in claim 1 further comprising spill collecting means for collecting spills from said apparatus; means for clarifying the collected spills; means for storing the clarified spills; means for concentrating the clarified spills; and a conduit operatively connecting the concentrating means for said spills to said incinerator.

7. Apparatus as recited in claim 1 wherein said recovering means for recovering sodium, carbonate, and/or sulfate comprises means for leaching the residue from said incinerator, and means for crystallizing and washing the leachate from said means for leaching.

8. Apparatus as recited in claim 7 further comprising means for recovering chlorine forms from said residue, and means for making chlorine dioxide from the recovered chlorine forms.

9. Apparatus as recited in claim 1 further comprising water treatment means connected to said concentrator means for treating water produced at said concentrator means from the concentration of said bleach plant liquid effluents.

10. Apparatus as recited in claim 9 further comprising means for feeding water from said water treatment means to said bleach plant to provide wash water and to other mill processes.

11. Apparatus as recited in claim 10 wherein said bleach plant includes a first chlorine dioxide stage, a second alkaline extraction stage with oxygen and peroxide addition, a $D_n$ stage, and a last chlorine dioxide stage; and wherein said means for supplying water from said water treatment plant to said bleach plant supplies the water to said last chlorine dioxide stage.

12. Apparatus as recited in claim 1 wherein said bleach plant has the following bleaching sequence: $AZE_o$ PZP.

13. Apparatus as recited in claim 1 wherein said incinerator comprises a circulating fluidized bed gasifier.

14. Apparatus as recited in claim 1 wherein said concentrating means comprises one or more of ultra-filtration means, reverse osmosis means, and freeze crystallization means.

* * * * *